US008066833B2

(12) United States Patent
Guindon et al.

(10) Patent No.: US 8,066,833 B2
(45) Date of Patent: Nov. 29, 2011

(54) NON-TOXIC BORON-CONTAINING IR TRACER COMPOSITIONS AND IR TRACER PROJECTILES CONTAINING THE SAME FOR GENERATING A DIM VISIBILITY IR TRACE

(75) Inventors: Louise Guindon, Ville de Laval (CA); Carol Jalbert, Lachenaie (CA); Daniel Lepage, Le Gardeur (CA)

(73) Assignee: General Dynamics Ordnance and Tactical Systems-Canada Inc., Le Gardeur, Quebec (CA)

( * ) Notice: Subject to any disclaimer, the term of this patent is extended or adjusted under 35 U.S.C. 154(b) by 208 days.

(21) Appl. No.: 11/910,757

(22) PCT Filed: Mar. 28, 2006

(86) PCT No.: PCT/CA2006/000459

§ 371 (c)(1),
(2), (4) Date: Jun. 7, 2008

(87) PCT Pub. No.: WO2006/105636

PCT Pub. Date: Oct. 12, 2006

(65) Prior Publication Data

US 2008/0257194 A1 Oct. 23, 2008

Related U.S. Application Data

(63) Continuation-in-part of application No. 11/098,413, filed on Apr. 5, 2005, now abandoned.

(51) Int. Cl.

| | |
|---|---|
| ***C06B 43/00*** | (2006.01) |
| ***C06B 47/10*** | (2006.01) |
| ***C06B 33/00*** | (2006.01) |
| ***C06B 31/02*** | (2006.01) |
| ***C06B 29/00*** | (2006.01) |
| ***D03D 23/00*** | (2006.01) |
| ***D03D 43/00*** | (2006.01) |

(52) U.S. Cl. ..... 149/61; 149/22; 149/37; 149/75; 149/109.4

(58) Field of Classification Search ..... 149/61, 149/22, 37, 75, 109.4
See application file for complete search history.

(56) References Cited

U.S. PATENT DOCUMENTS

| | | | | |
|---|---|---|---|---|
| 1,925,641 | A * | 9/1933 | Lucas | 149/37 |
| 5,525,166 | A * | 6/1996 | Cook | 149/77 |
| 5,639,984 | A * | 6/1997 | Nielson | 102/336 |
| 5,811,724 | A * | 9/1998 | Henry et al. | 149/18 |

* cited by examiner

*Primary Examiner* — James McDonough
(74) *Attorney, Agent, or Firm* — Sheema Khan; Miltons IP/p.i.

(57) ABSTRACT

A novel non-toxic IR tracer composition is provided herein which, when incorporated into an IR tracer projectile which is then fired, generates a dim visibility IR trace. Such IR tracer composition is a non-toxic, boron-containing, IR tracer composition comprising: from about 20 to about 30% by weight, or from about 45 to about 60% by weight, of potassium perchlorate; from about 5 to about 16% by weight of a metallic fuel which consists of boron; from about 20 to about 25% by weight, or from about 40 to about 50% by weight, of a non-metallic fuel which consists of sodium salicylate; from about 5 to about 10% by weight of a retardant which consists either of iron carbonate or magnesium carbonate; and an effective amount of binder, wherein the total percentage of such ingredients add up to 100%. A novel IR tracer projectile containing such IR tracer composition for generating a dim visibility IR trace is also provided.

21 Claims, 1 Drawing Sheet

NON-TOXIC BORON-CONTAINING IR TRACER COMPOSITIONS AND IR TRACER PROJECTILES CONTAINING THE SAME FOR GENERATING A DIM VISIBILITY IR TRACE

This application is a continuation-in-part of U.S. patent application Ser. No. 11/098,413 filed Apr. 5, 2005.

FIELD OF THE INVENTION

This invention relates to non-toxic, boron-containing, IR tracer compositions and to IR tracer projectiles containing such IR tracer compositions for generating a dim visibility IR trace.

BACKGROUND OF THE INVENTION

The art is replete with patents which are directed to compositions containing boron for various purposes, including, e.g., tracer compositions, incendiary compositions and pyrotechnic compositions. Among such prior art patents are the following:

U.S. Pat. No. 5,639,984, patented Jun. 17, 1997, INFRARED TRACER COMPOSITION and assigned to Thiokol Corporation. Those patented composition included strontium peroxide and barium peroxide in addition to boron. However, such infrared tracer compositions suffered the defect that barium was a toxic element.

U.S. Pat. No. 5,056,435, patented Oct. 15, 1991, INFRARED ILLUMINANT AND PRESSING METHOD, issued to L. L. Jones et al. Such patented compositions contained potassium nitrate as well as boron.

U.S. Pat. No. 6,635,130, patented Oct. 21, 2003, PYROTECHNIC COMPOSITION FOR PRODUCING IR-RADIATION, and assigned to Diehl Munitionssysteme GmbH & Co KG. Those patented compositions included magnesium in addition to other metals, including boron.

U.S. Pat. Nos. 6,485,586, 6,409,854; 6,402,864; and 4,915,756 all disclosed compositions which included titanium as well as boron. However, those compositions suffered the defects that the titanium also generated visible light and that they did not produce a cool IR trace.

Examples of patented pyrotechnic compositions comprising boron which did not produce a cool IR trace include U.S. Pat. Nos. 4,978,400; 4,406,228; and 3,695,951.

Examples of patented pyrotechnic compositions comprising boron but also containing toxic materials include U.S. Pat. Nos. 3,480,489 4,204,895; and 3,475,237.

SUMMARY OF THE INVENTION

Aims of the Invention

Tracer projectiles are now in general use since they provide a reliable means of determining whether projectiles impact on the desired target, or whether adjustments in aim are necessary. One problem with the use of conventional tracer projectiles is that they emit visible light, which thereby makes the source of the tracer projectile discernable to the enemy.

It would thus be desirable to suppress visible emissions, whereby camouflage is optimized and an enemy cannot visually locate the source of the tracer projectile or the line of fire in order to direct a counter-attack toward that location.

Accordingly it is an object of a first aspect of the present invention to provide improved IR tracer projectiles in which visible emissions, when viewed laterally or from the viewpoint of an enemy, are suppressed, whereby camouflage is optimized and an enemy cannot visually locate the source of the tracer projectile or the line of fire in order to direct a counter-attack toward that location.

An object of a second aspect of the present invention is to provide improved IR tracer projectiles which generate a trace which is substantially-completely IR radiation from the viewpoint of an enemy or a laterally placed onlooker.

It is an object of a third aspect of the present invention to provide improved IR tracer projectiles which generate a trace which is substantially-completely IR radiation from the viewpoint of an enemy or a laterally placed onlooker, and which has an appropriate burning rate so that it can be observed by an observer located at the firing position using an infrared detection system at a longer distance down range.

It is an object of a fourth aspect of the present invention to provide improved IR tracer projectiles which generate a trace which is substantially-completely IR radiation from the viewpoint of an enemy or a laterally placed onlooker, and which has a lower energetic output to minimize the risk of fire propagation in bushes and wooded areas where the projectile lands.

It is an object of a fifth aspect of the present invention to provide improved IR tracer projectiles which generate a trace which is substantially-completely IR radiation, and which has a controlled IR emission at any particular point to avoid very high intensity visible light emissions which could temporarily blind an observer using an infrared detection system.

It is an object of a sixth aspect of the present invention to provide improved IR tracer compositions which have a uniform granularity to facilitate the controlled production of the IR tracer projectiles which generate an IR trace which is substantially-completely IR radiation from the viewpoint of an enemy or a laterally placed onlooker.

It is an object of a seventh aspect of the present invention to provide improved IR tracer compositions which do not significantly degrade with time under extreme environmental conditions when stored at about 5 to 20.degree. C., and thus which provides IR tracer projectiles which generate an IR trace which is substantially-completely IR radiation.

It is an object of an eighth aspect of the present invention to provide improved IR tracer compositions which do not contain toxic heavy metals, e.g., barium nor any other toxic elements, and which are combined with a non-toxic igniter composition, to provide environmentally-friendly IR tracer compositions which are non-toxic, to provide IR tracer projectiles which generate an IR trace which is substantially-completely IR radiation from the viewpoint of an enemy or a laterally placed onlooker but which can be seen by an observer located at the firing position using an infrared detection system.

It is an object of a ninth aspect of the present invention to provide improved IR tracer compositions which are formulated using a selected solvent for mixing the ingredients in order to facilitate the manufacturing process by providing the IR tracer composition with uniform granularity and improved flowability, so that the IR tracer charge weight compressed into IR tracer projectiles which generate an IR trace which is substantially-completely IR radiation from the viewpoint of an enemy or a laterally placed onlooker could be better controlled.

Statements of Invention

A broad aspect of the present invention provides a non-toxic, boron-containing, infrared tracer composition for the projectile of tracer ammunition comprising: from about 20 to about 30% by weight, or from about 45 to about 60% by weight, of at least one of potassium perchlorate or sodium nitrate; from about 5 to about 16% by weight of a first fuel which consists of boron; optionally, from about 15 to about 25% by weight, or from about 40 to about 50% by weight, of a second fuel which consists of sodium salicylate; from about 5 to about 20% by weight of a retardant which consists of either iron carbonate, or magnesium carbonate or calcium carbonate; from about 5 to about 15% by weight of a first binder which consists of calcium resinate; and up to about 7.5% by weight of a synthetic resin binder which consists either of a copolymer of hexafluoropropylene and vinylidene fluoride or cellulose acetate butyrate, wherein the total percentage of such ingredients add up to 100%.

Other embodiments and aspects of the invention comprise the following metallic boron-containing, JR tracer compositions:

From about 8 to about 12% by weight of boron; from about 20 to about 30% by weight of potassium perchlorate; from about 8 to about 12% by weight of magnesium carbonate; from about 40 to about 50% by weight of sodium salicylate; and from about 8 to about 12% by weight of calcium resinate; wherein the total percentage of the ingredients add up to 100%;

About 10% by weight of boron; about 25% by weight of potassium perchlorate; about 10% by weight of magnesium carbonate; about 45% by weight of sodium salicylate; and about 10% by weight of calcium resinate; wherein the total percentage of the ingredients add up to 100%;

From about 8 to about 12% by weight of boron; from about 20 to about 30% by weight of potassium perchlorate; from about 8 to about 12% by weight of iron carbonate; from about 40 to about 50% by weight of sodium salicylate; and from about 8 to about 12% by weight of calcium resinate; wherein the total percentage of the ingredients add up to 100%;

About 10% by weight of boron; about 25% by weight of potassium perchlorate; about 10% by weight of iron carbonate; about 45% by weight of sodium salicylate; and about 10% by weight of calcium resinate; wherein the total percentage of said ingredients add up to 100%;

From about 10 to about 14% by weight of boron; from about 20 to about 30% by weight of potassium perchlorate; from about 8 to about 12% by weight of iron carbonate; from about 42 to about 50% by weight of sodium salicylate; and from about 8 to about 12% by weight of calcium resinate; wherein the total percentage of the ingredients add up to 100%;

About 12% by weight of boron; about 20% by weight of potassium chlorate; about 10% by weight of iron carbonate; about 48% by weight of sodium salicylate; and about 10% by weight of calcium resinate; wherein the total percentage of the ingredients add up to 100%;

From about 8 to about 12% by weight of boron; from about 20 to about 29% by weight of potassium chlorate; from about 8 to about 12% by weight of iron carbonate; from about 45 to about 50% by weight of sodium salicylate; and from about 8 to about 12% by weight of calcium resinate; wherein the total percentage of the ingredients add up to 100%;

About 6% by weight of boron; about 24% by weight of potassium perchlorate; about 10% by weight of iron carbonate; about 50% by weight of sodium salicylate; and about 10% by weight of calcium resinate; wherein the total percentage of the ingredients add up to 100%;

From about 4 to about 8% by weight of boron; from about 20 to about 30% by weight of potassium perchlorate; from about 8 to about 12% by weight of iron carbonate; from about 40 to about 48% by weight of sodium salicylate; and from about 8 to about 12% by weight of calcium resinate; wherein the total percentage of the ingredients add up to 100%;

About 6% by weight of boron; about 30% by weight of potassium perchlorate; about 10% by weight of iron carbonate; about 44% by weight of sodium salicylate; and about 10% by weight of calcium resinate; wherein the total percentage of the ingredients add up to 100%;

From about 10 to about 14% by weight of boron; from about 24 to about 30% by weight of potassium perchlorate; from about 8 to about 12% by weight of iron carbonate; from about 40 to about 50% by weight of sodium salicylate; and from about 8 to about 12% by weight of calcium resinate; wherein the total percentage of the ingredients add up to 100%;

About 12% by weight of boron; about 28% by weight of potassium perchlorate; about 10% by weight of iron carbonate; about 40% by weight of sodium salicylate; and about 10% by weight of calcium resinate; wherein the total percentage of the ingredients add up to 100%;

From about 12 to about 16% by weight of boron; from about 20 to about 30% by weight of potassium perchlorate; from about 8 to about 12% by weight of iron carbonate; from about 40 to about 45% by weight of sodium salicylate; and from about 8 to about 12% by weight of calcium resinate; wherein the total percentage of the ingredients add up to 100%;

About 16% by weight of boron; about 24% by weight of potassium perchlorate; about 10% by weight of iron carbonate; about 40% by weight of sodium salicylate; and about 10% by weight of calcium resinate; wherein the total percentage of the ingredients add up to 100%;

From about 9 to about 13% by weight of boron; from about 20 to about 30% by weight of potassium perchlorate; from about 8 to about 12% by weight of iron carbonate; from about 45 to about 49% by weight of sodium salicylate; and from about 8 to about 12% by weight of calcium resinate; wherein the total percentage of the ingredients add up to 100%;

About 11% by weight of boron; about 22% by weight of potassium perchlorate; about 10% by weight of iron carbonate; about 47% by weight of sodium salicylate; and about 10% by weight of calcium resinate; wherein the total percentage of the ingredients add up to 100%;

From about 8 to about 12% by weight of boron; from about 40 to about 50% by weight of potassium perchlorate; from about 8 to about 10% by weight of magnesium carbonate; from about 20 to about 30% by weight of sodium salicylate; and from about 8 to about 12% by weight of calcium resinate; wherein the total percentage of the ingredients add up to 100%;

About 10% by weight of boron; about 45% by weight of potassium perchlorate; about 10% by weight of magnesium carbonate; about 25% by weight of sodium salicylate; and about 10% by weight of calcium resinate; wherein the total percentage of the ingredients add up to 100%;

From about 5 to about 8% by weight of boron; from about 55 to about 60% by weight of potassium perchlorate; from about 5 to about 7% by weight of iron carbonate; from about 20 to about 22% by weight of sodium salicylate; and from about 8 to about 12% by weight of calcium resinate; wherein the total percentage of the ingredients add up to 100%; and About 5% by weight of boron; about 60% by weight of potassium perchlorate; about 5% by weight of iron carbonate; about 20% by weight of sodium salicylate; and about 10% by weight of calcium resinate; wherein the total percentage of the ingredients add up to 100%.

The present invention, in another aspect, also provides an IR tracer projectile comprising: a hollow cylindrical shell made of a suitable metallic material having a conical nose; a conventional heavy filler disposed in the hollow conical nose; the non-toxic, boron-containing IR tracer composition as described above in its generic and specific aspects, compressed immediately against the filler; a conventional ignition material compressed against the compressed tracer composition; and a metal disc capping the hollow shell.

Generalized Description of the Invention

The present invention provides infrared-producing (hereafter "IR" producing) compositions which are capable of producing a consistent IR output when provided in tracer projectiles which are fired from either rifles or machine guns. The IR output includes near IR and far IR bands (0.76 to 3.0 μm). The intensity of the IR radiation depends on the specific wavelength of these bands.

Conventional IR radiation-emitting pyrotechnic compositions typically contain a finely-divided mixture of an oxidizer and a fuel (metallic, non-metallic or organic fuel). The oxidizer contains oxygen to sustain combustion and the metallic atoms are responsible for the characteristic color output. To sustain combustion of the mixture and to provide heat energy, a supplementary fuel is normally added.

Finely divided powdered fuel in conventional IR radiation emitting pyrotechnic mixtures is very reactive with an oxidizing agent. Above a certain temperature, namely, the ignition temperature, the oxidizer decomposes to release oxygen, which then reacts quickly with the fuel in an exothermic reaction. An oxidizer and a fuel alone, however, do not make practical pyrotechnics for the purpose of providing IR emission. A flame retardant and a binding agent are also incorporated into such compositions.

The IR tracer compositions of aspects of the present invention possess unique requirements not generally addressed by the prior art conventional IR tracer compositions. While it is not desired to be limited to any particular theory, it is believed that a hypothesis concerning the objective of formation of purely IR emission without the presence of visible light may be developed based on black body radiation theory. The requirement would then be for the tracer to maximize output at a wavelength in the 1 to 3 μm range.

The desired IR range is significantly below the flame temperature of present conventional tracer and flame formulations. This knowledge, coupled with the understanding that visible light output is normally the smallest proportion of energy radiation during combustion, leads to the conclusion that an effective IR tracer according to aspects of the present invention is based on a relatively cool burning IR tracer composition.

Various chemical compositions were investigated to maximize the IR intensity, to maximize the duration of the IR trace for each type of small caliber projectiles and to provide a relatively cool burning IR tracer composition. The IR tracer compositions to be described hereinafter burn cleanly with not too much heat generated and emit relatively-small, almost negligible, quantities of visible light in proportion to the IR radiation emitted. This composition has been found to provide, upon firing of an ammunition round from a firing position, the passing of an IR tracer projectile which cannot be seen with the naked eye by an observer viewing the trajectory of the IR tracer projectile from a position located perpendicular to the trajectory path at 200 m down range, and at 400 m down range, from the firing position while providing an IR trace which is visible from the firing position.

The basic components of the compositions of the present invention are able to augment near IR emissions when fired. This is accomplished by the addition of IR producing oxidizer and fuel.

The preferred oxidizer is potassium perchlorate, but, alternatively, potassium nitrate may also be used. Potassium perchlorate ($KClO_4$) is the preferred oxidizer because it liberates a large amount of oxygen (46% max) and is stable as a function of time. Sodium perchlorate would not be suitable since sodium emits a visible yellow light. Lithium perchlorate would not be suitable since lithium emits a visible red light. The preferred organic fuel when used is sodium salicylate ($C_7H_5NaO_3$). This organic fuel has a low melting point and generates a large amount of gases during the combustion, which facilitates the removal of solid residues and soot inside the tracer cavity of the projectile. Without obstruction, the trace can be seen through an infrared viewer at a longer distances down range. Neither lithium salicylate nor potassium salicylate would be suitable since they provide compositions which are too hygroscopic. Furthermore, these compounds are not conveniently commercially available.

The preferred flame retardants are iron carbonate and magnesium carbonate although calcium carbonate would also be useful. The presence of iron carbonate, magnesium carbonate or calcium carbonate brings about a better control of the rate of burning and substantially reduces the flash and output of visible light at the point of firing. The carbonates of other transition metals are not suitable. For example, the residues of carbonates of chromium and cobalt contaminate the atmosphere, the carbonate of nickel has carcinogenic properties and the carbonate of zirconium has excessive luminosity properties.

The sole nonorganic fuel in the composition of aspects of the present invention is boron. It contributes substantially to the exothermic reaction with the oxidizer and to a better combustion of the IR formulation and provides almost exclusively IR radiation and a cool burning IR trace. It provides IR tracer compositions having all the desired characteristics to be described in further detail hereinafter.

A binder maintains the other particulate forms of the constituents of the IR tracer composition together. The binder increases the structural integrity of the IR tracer material to prevent any break up of the IR trace in flight. It protects the IR tracer composition from moisture and increases the flowability of the composition. The preferred binder agent is calcium resinate which is added to the composition as a fuel retardant and acts as a waterproofing agent. Other binders, e.g. cellulose acetate butyrate (CAB) or the fluorocarbon elastomer known by the trade mark VITON A are suitable since they reduce soot formation.

BRIEF DESCRIPTION OF THE DRAWING

Embodiments of the present invention will be described, by way of example only, with reference also to the attached FIGURE, which is a one-half longitudinal cross-section of a tracer projectile according to one embodiment of the present invention.

EXAMPLES

Preparation of Compositions

Figure 1:
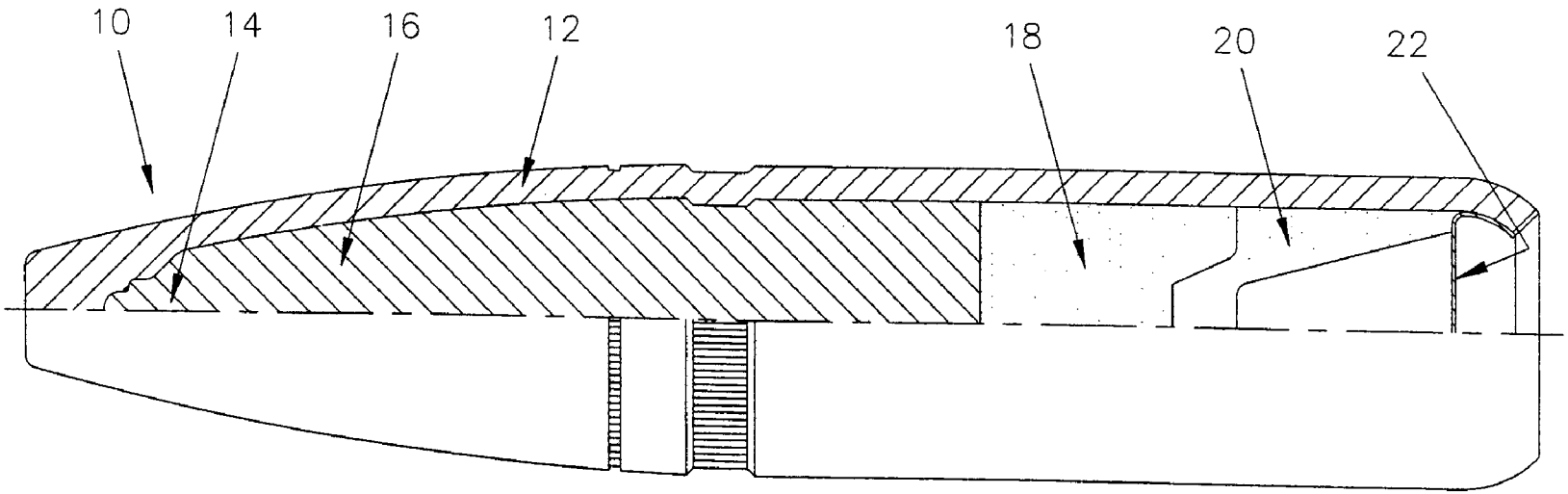

The IR tracer compositions were prepared by first dry mixing the powdered ingredients to provide a dry intermediate composition. The binder was dissolved in a suitable aprotic solvent, namely, methyl ethyl ketone. The so-formed binder solution was then incorporated into the dry intermediate composition to provide a wet mixture. The wet mixture so provided was transferred to a suitable mixer in order to obtain a substantially-completely homogeneous mixture of all ingredients. The homogenous mixture so-formed was dried in an oven at about 20-40° C. until it was sufficiently dry for sieving. The dry mixture was then sieved to break up agglomerated particles. The IR tracer compositions are thus provided as relatively small particles of random shape.

A series of IR tracer compositions was prepared according to the proportion of ingredients as set forth in the following Tables 1A and 1B.

TABLE 1A

| | PERCENTAGE IN TEST NO TEST NO | | | | | |
|---|---|---|---|---|---|---|
| INGREDIENT | DT-63 | DT-64 | DT-65 | DT-67 | DT-71 | DT-72 |
| BORON | 10 | 10 | 5 | 10 | 12 | 6 |
| POTASSIUM CHLORATE | 45 | 25 | 60 | 25 | 20 | 24 |
| IRON CARBONATE | 0 | 0 | 5 | 10 | 10 | 10 |
| MAGNESIUM CARBONATE | 10 | 10 | 0 | 0 | 0 | 0 |
| SODIUM SALICYLATE | 25 | 45 | 20 | 45 | 48 | 50 |
| CALCIUM RESINATE | 10 | 10 | 10 | 10 | 10 | 10 |

TABLE 1B

| | PERCENTAGE IN TEST NO TEST NO | | | |
|---|---|---|---|---|
| INGREDIENT | DT-73 | DT-74 | DT-75 | DT-76 |
| BORON | 6 | 12 | 16 | 11 |
| POTASSIUM CHLORATE | 30 | 28 | 24 | 22 |
| IRON CARBONATE | 10 | 10 | 10 | 10 |
| MAGNESIUM CARBONATE | 10 | 10 | 0 | 0 |
| SODIUM SALICYLATE | 44 | 40 | 40 | 47 |
| CALCIUM RESINATE | 10 | 10 | 10 | 10 |

Preparation of Test Projectiles

Each of the above IR tracer compositions was compressed into a projectile body of the desired caliber. For the tests which are to be described below, the caliber was 5.56/7.62 mm, i.e., for a rifle. Thus, as seen in the drawing, the tracer projectile 10 includes a hollow shell 12 of, preferably, a copper alloy (90% Cu/10% Zn), whose nose 14 is filled with a suitable conventional heavy filler 16. The IR tracer composition 18 is compressed immediately against the filler 16. A conventional ignition material 20 is compressed against the tracer composition 18. The tracer projectile 10 is capped by means of a closure disc 22, preferably of brass.

Test Procedures

For these series of tests, each of which the IR tracer compositions was inserted into 5.56 mm tracer projectiles and fired. When the IR tracer projectile was fired, the IR tracer composition inside the projectile body, through the ignition material 20, was ignited by hot gases emitted by a propellant and an IR trace was produced.

Several important criteria for the IR trace, namely its stability, its intensity, whether any visible light was detected and if a spark occurred at the firing point, were evaluated as follows:

Three observers were stationed, one each, at the point of firing, at 250 m down range and at 400 m down range. These observers noted each of the above criteria.

The visibility with night vision goggles was determined by the same observers at the same three positions.

The distinctness of the IR trace was noted at a barrier located 1000 m down range. NATO criteria is distinctness of the IR trace at 600 m down range.

The visibility with the naked eye of the tracer projectile was determined at the firing position along the trajectory path and perpendicular to the trajectory path at 200 m down range and at 400 m down range from the firing position.

The calorific output of the tracer projectile was measured with a calorimeter.

The results are summarized as follows:

The IR trace was found to be visible with IR vision viewers from the firing position and could not be seen with the naked eye by an observer placed at an angle with respect to the trajectory of the IR tracer projectile and position along the trajectory path and perpendicular to the trajectory path at 200 m down range and at 400 m down range from the firing position.

The calorific output of the IR tracer composition measured with a calorimeter was about 500 cal/g, which is about one third less than the calorific output generated by conventional tracer compositions, (500 cal/g compared to 1200 cal/g for conventional tracer compositions). The IR trace can, thus, be designated as a cool IR trace.

The IR intensity of the IR emission as measured with a spectrophotometer equipped with IR filters at a wavelength of 760 nanometers was found to be about 1 to 0.4 watts/steradian and at a wavelength of 3,000 nanometers was found to be about 1.7 to 2.1 watts/steradian. The IR tracer compositions of aspects of the present invention was found to have an IR luminosity as measured with a spectrophotometer at a wavelength of 760 nanometers of about 1 to 2 watts/steradian and an IR luminosity as measured with a spectrophotometer at a wavelength 3000 nanometers of about 1 to 4 watts/steradian.

For 5.56 mm tracer projectiles, the IR tracer can be seen from the firing position up to 1000 m compared to up to the NATO standard of about 600 m for 5.56 mm conventional tracer projectile.

The IR projectiles of an aspect of the present invention containing the IR tracer compositions of aspects of the present invention have been found to increase the length of visibility of the IR trace along the firing line as viewed from the firing position to up to about 120% with prior performance being at 100%.

It has been found that the IR tracer compositions of aspects of the present invention produce relatively low burn rate materials so that the IR trace can be seen from the firing point to a longer distance down range. The burn rate is adjustable for 5.56 mm and 7.62 mm ammunition to meet or exceed NATO and specific user requirements. The IR tracer compositions of aspects of the present invention are also applicable to short/limited range training ammunition (5.56 mm, 7.62 mm). Thus, particular burn rates can be adjusted, the ratio of IR radiation to visible light can be optimized (i.e., substantially no visible light), and the general physical and chemical properties can be carefully selected.

The IR tracer compositions of aspects of the present invention do not degradade with time, when properly stored at a temperature varying between 5° C. and 20° C., with a relative humidity which ranged between 50% and 70%. For example, the calorific heat of an IR tracer projectile containing IR tracer compositions of aspects of the present invention at the beginning of the storage period was about 500 cal/g and remained constant over a minimum storage period of 6 months. The IR tracer compositions of aspects of the present invention do not contain any toxic elements which leave a toxic residue after firing.

The IR tracer compositions of aspects of the present invention may easily be industrialized.

Not all boron-containing compositions satisfy the utility requirements which are met by the IR tracer compositions of aspects of the present invention. Thus, compositions having the ingredients/proportions set forth in the following Tables 2A and 2B below have been found not to be useful when subjected to the above tests.

TABLE 2A

| | PERCENTAGE IN TEST NO TEST NO | | | | |
|---|---|---|---|---|---|
| INGREDIENT | DT-09 | DT-10 | DT-11 | DT-12 | DT-25 |
| BORON | 10 | 10 | 10 | 10 | 19 |
| POTASSIUM NITRATE | 25 | 25 | 25 | 25 | 0 |
| MAGNESIUM CARBONATE | 10 | 10 | 10 | 10 | 10 |
| POLYISOBUTYLENE | 5 | 5 | 5 | 5 | 3 |
| ZINC PEROXIDE | 50 | 0 | 0 | 0 | 0 |
| CESIUM NITRATE | 0 | 0 | 0 | 50 | 0 |
| STRONTIUM OXIDE | 0 | 0 | 50 | 0 | 0 |
| POTASSIUM CHLORATE | 0 | 0 | 0 | 0 | 28 |

TABLE 2B

| | PERCENTAGE IN TEST NO TEST NO | | | | |
|---|---|---|---|---|---|
| INGREDIENT | DT-26 | DT-27 | DT-28 | DT-29 | DT-30 |
| BORON | 19 | 10 | 4 | 4 | 11 |
| POTASSIUM CHLORATE | 38 | 47 | 45 | 34 | 38 |
| MAGNESIUM CARBONATE | 10 | 0 | 0 | 0 | 0 |
| POLYISOBUTYLENE | 3 | 3 | 3 | 3 | 3 |
| ZINC PEROXIDE | 30 | 30 | 38 | 49 | 38 |
| STRONTIUM OXIDE | 0 | 0 | 50 | 0 | 0 |

SUMMARY

In summary, the present invention provides IR tracer compositions for small caliber ammunition. The IR tracer compositions of aspects of the present invention produce a non-toxic residue and when provided in an IR tracer projectile and fired, produced an IR trace having a lower calorific output than conventional compositions. The IR trace is not visible by the naked eye, i.e., it is a dim trace. The rate of burning is selectively controllable so that the IR tracer can be seen at longer distance from the firing position than the IR trace provided by conventional IR tracer compositions.

The above-described embodiments of aspects of the invention are intended to be examples of the present invention. Alterations, modifications and variations may be effected to the particular embodiments by those of ordinary skill in the art, without departing from the spirit and scope of the invention, which is defined solely by the claims appended hereto.

The invention claimed is:

1. A non-toxic, boron-containing, infrared tracer composition for use in with an igniter, said tracer composition having an infrared output in the range of 0.76 μm to 3.0 μm and a cool IR trace, said tracer comprising: from about 20 to about 30% by weight, or from about 45 to about 60% by weight of at least one of potassium perchlorate and sodium nitrate; from about 5 to about 16% by weight of a first fuel which consists of a boron; from about 15 to about 25% by weight, or from about 40 to about 50% by weight, of a second fuel which consists of sodium salicylate; from about 5 to about 20% by weight of a retardant which is selected from the group consisting of iron carbonate and magnesium carbonate or calcium carbonate; from about 5 to about 15% by weight of a first binder which consists of calcium resinate; and optionally up to about 7.5% by weight of a synthetic resin binder which is selected from the group consisting of a copolymer of hexafluoropropylene and vinylidene fluoride, and cellulose acetate butyrate; with the proviso that said composition excludes peroxides, and wherein the total percentage of said ingredients add up to 100%.

2. The non-toxic, boron-containing, infrared tracer composition as claimed in claim 1, comprising: from about 8 to about 12% by weight of boron; from about 20 to about 30% by weight of potassium perchlorate; from about 8 to about 12% by weight of magnesium carbonate; from about 40 to about 50% by weight of sodium salicylate; and from about 8 to about 12% by weight of calcium resinate; wherein the total percentage of said ingredients add up to 100%.

3. The non-toxic, boron-containing, infrared tracer composition as claimed in claim 2, comprising: about 10% by weight of boron; about 25% by weight of potassium perchlorate; about 10% by weight of magnesium carbonate; about 45% by weight of sodium salicylate; and about 10% by weight of calcium resinate; wherein the total percentage of said ingredients add up to 100%.

4. The non-toxic, boron-containing, infrared tracer composition as claimed in claim 1, comprising: from about 8 to about 12% by weight of boron; from about 20 to about 30% by weight of potassium perchlorate; from about 8 to about 12% by weight of iron carbonate; about 40 to about 50% by weight of sodium salicylate; and from about 8 to about 12% by weight of calcium resinate; wherein the total percentage of said ingredients add up to 100%.

5. The non-toxic, boron-containing, infrared tracer composition as claimed in claim 4, comprising: about 10% by weight of boron; about 25% by weight of potassium perchlorate; about 10% by weight of iron carbonate; about 45% by weight of sodium salicylate; and about 10% by weight of calcium resinate; wherein the total percentage of said ingredients add up to 100%.

6. The non-toxic, boron-containing, infrared tracer composition as claimed in claim 1, comprising: from about 10 to about 14% by weight of boron; from about 20 to about 30% by weight of potassium perchlorate; from about 8 to about 12% by weight of iron carbonate; from about 42 to about 50% by weight of sodium salicylate;

and from about 8 to about 12% by weight of calcium resinate; wherein the total percentage of said ingredients add up to 100%.

7. The non-toxic, boron-containing, infrared tracer composition as claimed in claim 6, comprising: about 12% by weight of boron; about 20% by weight of potassium perchlorate; about 10% by weight of iron carbonate; about 48% by weight of sodium salicylate; and about 10% by weight of calcium resinate; wherein the total percentage of said ingredients add up to 100%.

8. The non-toxic, boron-containing, infrared tracer composition as claimed in claim 1, comprising: from about 8 to about 12% by weight of-boron; from about 20 to about 29% by weight of potassium perchlorate; from about 8 to about 12% by weight of iron carbonate; from about 45 to about 50% by weight of sodium salicylate; and from about 8 to about 12% by weight of calcium resinate; wherein the total percentage of said ingredients add up to 100%.

9. The non-toxic, boron-containing, infrared tracer composition as claimed in claim 8, comprising: about 6% by weight of boron; about 24% by weight of potassium perchlorate; about 10% by weight of iron carbonate; about 50% by weight of sodium salicylate; and about 10% by weight of calcium resinate; wherein the total percentage of said ingredients add up to 100%.

10. The non-toxic, boron-containing, infrared tracer composition as claimed in claim 1, comprising: from about 5 to about 8% by weight of boron; from about 20 to about 30% by weight of potassium perchlorate; from about 8 to about 12% by weight of iron carbonate; from about 40 to about 48% by weight of sodium salicylate;

and from about 8 to about 12% by weight of calcium resinate; wherein the total percentage of said ingredients add up to 100%.

11. The non-toxic, boron-containing, infrared tracer composition as claimed in claim 10, comprising: about 6% by weight of boron; about 30% by weight of potassium perchlorate; about 10% by weight of iron carbonate; about 44% by weight of sodium salicylate; and about 10% by weight of calcium resinate; wherein the total percentage of said ingredients add up to 100%.

12. The non-toxic, boron-containing, infrared tracer composition as claimed in claim 1, comprising: from about 10 to about 14% by weight of -boron; from about 24 to about 30% by weight of potassium perchlorate; from about 8 to about 12% by weight of iron carbonate; from about 40 to about 50% by weight of sodium salicylate; and from about 8 to about 12% by weight of calcium resinate; wherein the total percentage of said ingredients add up to 100%.

13. The non-toxic, -boron-containing, infrared tracer composition as claimed in claim 12, comprising: about 12% by weight of -boron; about 28% by weight of potassium perchlorate; about 10% by weight of iron carbonate; about 40% by weight of sodium salicylate; and about 10% by weight of calcium resinate; wherein the total percentage of said ingredients add up to 100%.

14. The non-toxic, boron-containing, infrared tracer composition as claimed in claim 1, comprising: from about 12 to about 16% by weight of boron; from about 20 to about 30% by weight of potassium perchlorate; from about 8 to about 12% by weight of iron carbonate; from about 40 to about 45% by weight of sodium salicylate; and from about 8 to about 12% by weight of calcium resinate; wherein the total percentage of said ingredients add up to 100%.

15. The non-toxic, boron-containing, infrared tracer composition as claimed in claim 14, comprising: about 16% by weight of boron; about 24% by weight of potassium perchlorate; about 10% by weight of iron carbonate; about 40% by weight of sodium salicylate; and about 10% by weight of calcium resinate; wherein the total percentage of said ingredients add up to 100%.

16. The non-toxic, boron-containing, infrared tracer composition as claimed in claim 1, comprising: from about 9 to about 13% by weight of boron; from about 20 to about 30% by weight of potassium perchlorate; from about 8 to about 12% by weight of iron carbonate; from about 45 to about 49% by weight of sodium salicylate;

and from about 8 to about 12% by weight of calcium resinate; wherein the total percentage of said ingredients add up to 100%.

17. The non-toxic, boron-containing, infrared tracer composition as claimed in claim 16, comprising: about 11% by weight of boron; about 22% by weight of potassium perchlorate; about 10% by weight of iron carbonate; about 47% by weight of sodium salicylate; and about 10% by weight of calcium resinate; wherein the total percentage of said ingredients add up to 100%.

18. The non-toxic, boron-containing, infrared tracer composition as claimed in claim 1, comprising: from about 8 to about 12% by weight of boron; from about 45 to about 50% by weight of potassium perchlorate; from about 8 to about 10% by weight of magnesium carbonate; from about 15 to about 25% by weight of sodium salicylate; and from about 8 to about 12% by weight of calcium resinate; wherein the total percentage of said ingredients add up to 100%.

19. The non-toxic, boron-containing, infrared tracer composition as claimed in claim 18, comprising: about 10% by weight of boron; about 45% by weight of potassium perchlorate; about 10% by weight of magnesium carbonate; about 25% by weight of sodium salicylate; and about 10% by weight of calcium resinate; wherein the total percentage of said ingredients add up to 100%.

20. The non-toxic, boron-containing, infrared tracer composition as claimed in claim 1, comprising: from about 5 to about 8% by weight of boron; from about 55 to about 60% by weight of potassium perchlorate; from about 5 to about 7% by weight of iron carbonate; from about 20 to about 22% by weight of sodium salicylate; and from about 8 to about 12% by weight of calcium resinate; wherein the total percentage of said ingredients add up to 100%.

21. The non-toxic, boron-containing, infrared tracer composition as claimed in claim 20, comprising: about 5% by weight of boron; about 60% by weight of potassium perchlorate; about 5% by weight of iron carbonate; about 20% by weight of sodium salicylate; and about 10% by weight of calcium resinate; wherein the total percentage of said ingredients add up to 100%.

* * * * *